US008845303B2

(12) United States Patent
Wang

(10) Patent No.: US 8,845,303 B2
(45) Date of Patent: Sep. 30, 2014

(54) TORQUE CONTROL FOR OPEN CIRCUIT PISTON PUMP

(75) Inventor: Shu Wang, Shakopee, MN (US)

(73) Assignee: Eaton Corporation, Cleveland, OH (US)

( * ) Notice: Subject to any disclaimer, the term of this patent is extended or adjusted under 35 U.S.C. 154(b) by 129 days.

(21) Appl. No.: 13/335,595

(22) Filed: Dec. 22, 2011

(65) Prior Publication Data

US 2012/0186441 A1 Jul. 26, 2012

Related U.S. Application Data

(60) Provisional application No. 61/425,948, filed on Dec. 22, 2010.

(51) Int. Cl.

| | |
|---|---|
| ***F04B 1/29*** | (2006.01) |
| ***F04B 1/32*** | (2006.01) |
| ***F04B 1/34*** | (2006.01) |
| ***F04B 1/14*** | (2006.01) |
| ***F04B 49/12*** | (2006.01) |
| ***F03C 1/06*** | (2006.01) |
| ***F04B 1/20*** | (2006.01) |
| ***F04B 49/22*** | (2006.01) |

(52) U.S. Cl.

CPC ..... *F03C 1/0668* (2013.01); *F04B 1/146* (2013.01); *F04B 49/125* (2013.01); *F04B 1/2078* (2013.01); *F04B 49/22* (2013.01)

USPC ..... 417/222.1; 91/504; 137/82

(58) Field of Classification Search

USPC ..... 91/504, 505; 417/222.2, 222.1; 137/82

See application file for complete search history.

(56) References Cited

U.S. PATENT DOCUMENTS

| | | | | |
|---|---|---|---|---|
| 2,874,542 | A | 2/1959 | Tear | |
| 3,830,594 | A * | 8/1974 | Hein et al. | 417/217 |
| 5,486,097 | A | 1/1996 | Schaffner | |
| 6,095,760 | A | 8/2000 | Houtman | |
| 2006/0073747 | A1 * | 4/2006 | Harada et al. | 440/75 |
| 2006/0123984 | A1 * | 6/2006 | Wanschura et al. | 91/505 |
| 2010/0236399 | A1 | 9/2010 | Gulati | |

FOREIGN PATENT DOCUMENTS

EP 1 645 502 A2 4/2006

OTHER PUBLICATIONS

International Search Report and Written Opinion for PCT/US2011/066925 mailed Feb. 1, 2013.

* cited by examiner

*Primary Examiner* — Bryan Lettman

(74) *Attorney, Agent, or Firm* — Merchant & Gould P.C.

(57) ABSTRACT

A pump control system and a torque control valve are disclosed. In one embodiment, the torque control valve includes a sleeve, a spool disposed in the sleeve, and a piston rod disposed through the spool. The spool has a first recess area, a second recess area, and a third recess area. The first and third recess areas each have a port extending into a central bore of the spool. The piston rod includes a groove orifice feature having a spiral groove and is configured such that a fluid flowing from the port in the first recess area to the port in the third recess area must flow through at least a portion of the spiral groove. The fluid flowing through the spiral groove operates to bias the spool in a direction towards the second axial end of the spool.

18 Claims, 9 Drawing Sheets

TORQUE CONTROL FOR OPEN CIRCUIT PISTON PUMP

RELATED APPLICATIONS

This application claims a right of priority to U.S. Provisional Patent Application Ser. No. 61/425,948, filed Dec. 22, 2010, the entirety of which is hereby incorporated by reference herein.

BACKGROUND

A variable displacement axial piston pump/motor includes a swashplate against which axial pistons are slidably engaged. The swashplate is adapted to pivot about an axis in order to increase or decrease the displacement of the axial piston pump/motor.

Some axial piston pumps/motors include a torque control valve that is adapted to adjust the displacement of the swashplate to limit the maximum torque back on an engine by decreasing flow in high pressure situations, and preventing engine stall. Torque control valves of this type, which are generally of a hydro-mechanical design, typically provide flow to a control piston that is adapted to adjust the position of the swashplate relative to the axis. Improvements are desired.

SUMMARY

A pump control system and a torque control valve are disclosed. In one embodiment, the torque control valve includes a sleeve having a first axial end, a second axial end, and a central bore. The sleeve has a system pressure port, a compensator pressure port, and a control pressure port. Each of the pressure ports extends into the central bore of the sleeve. The torque control valve also includes a spool disposed within the central bore of the sleeve. The spool has a first axial end, a second axial end, and a central bore. The spool also has a first recess area, a second recess area, and a third recess area between the first and second axial ends of the spool. The first and third recesses each have a port extending into the spool central bore. The torque control valve also includes a piston rod disposed through the central bore of the spool. The piston rod includes a groove orifice feature having a spiral groove and is configured such that a fluid flowing from the port in the first recess area to the port in the third recess area must flow through at least a portion of the spiral groove. The fluid flowing through the spiral groove operates to bias the spool in a direction towards the second axial end of the spool. The groove orifice is designed as variable pitch distance that may provide desired constant torque control limitations. This design also only needs one spring to adjust the torque settings that allows for the adjustment mechanism for the spring to be externally operated. In one embodiment, a spring is provided to bias the spool towards its first axial end. In one embodiment, a solenoid valve is provided to actively position the spool.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
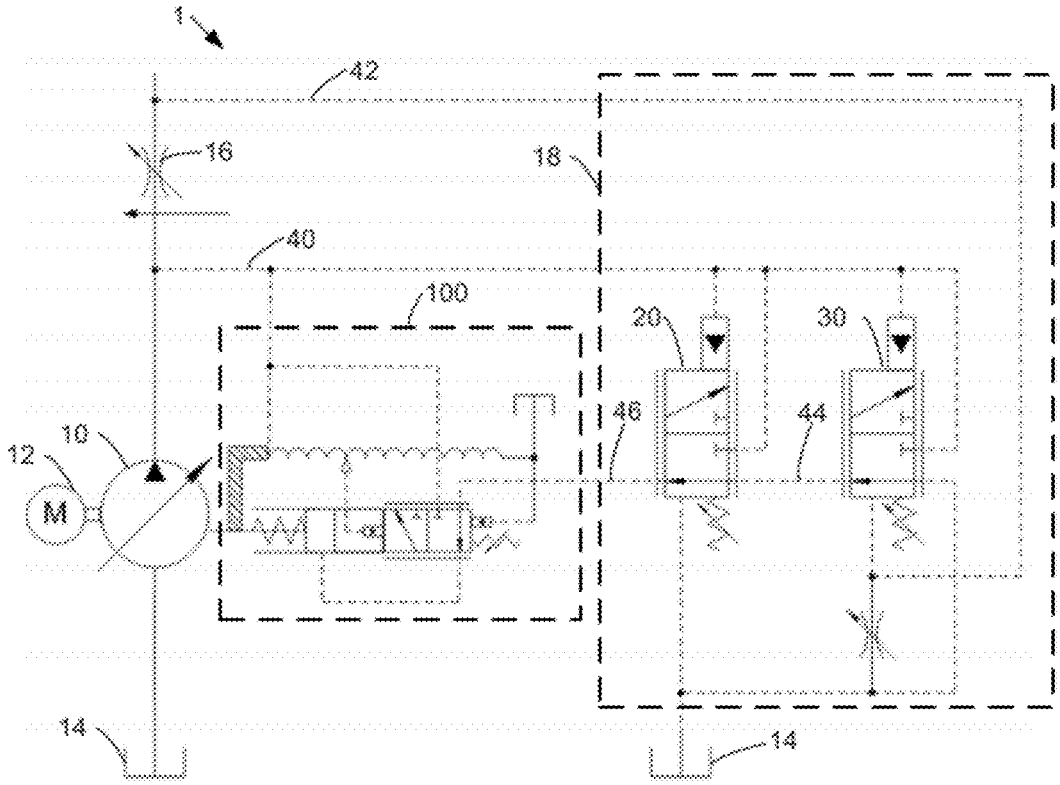
FIG. 1 is a hydraulic schematic of a pump control system having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring now to FIG. 1, an example pump control system 1 is shown. Pump control system includes a motor 12 configured to drive a pump 10. In one embodiment, motor 12 is a gear box transmission from an engine power take-off while pump 10 is a variable axial piston pump. As shown, pump 10 delivers and pressurizes fluid from a tank 14 to a control valve 16 at a system pressure 40. In one embodiment control valve 16 can modulate to meet a load pressure 42.

In order to ensure that the system pressure 40 matches the load pressure 42 as closely as possible, a compensation circuit 18 is provided. In the embodiment shown, compensation circuit 18 includes a pressure limiting compensation valve 20 and a load sense compensation valve 30. Pressure limiting and load sense compensation valves are well known in the art and will not be discussed further herein. In the configuration shown, the load sense compensation valve 30 output 44 feeds into the pressure limiting compensation valve which in turn provides an output compensation pressure 46. Both of the valves 120, 130 also drain to tank 14.

Pump control system 1 also includes a torque control valve 100. Torque control valve 100 is for adjusting the displacement of a swashplate 60 of the pump 10 to limit the maximum torque back on an engine, via motor 12, by decreasing flow in high pressure situations. The general operation and function of torque control valves is described in U.S. Publication 2010/

0236399 to Gulati, published on Sep. 23, 2010, the entirety of which is incorporated by reference herein.

Figure 2:
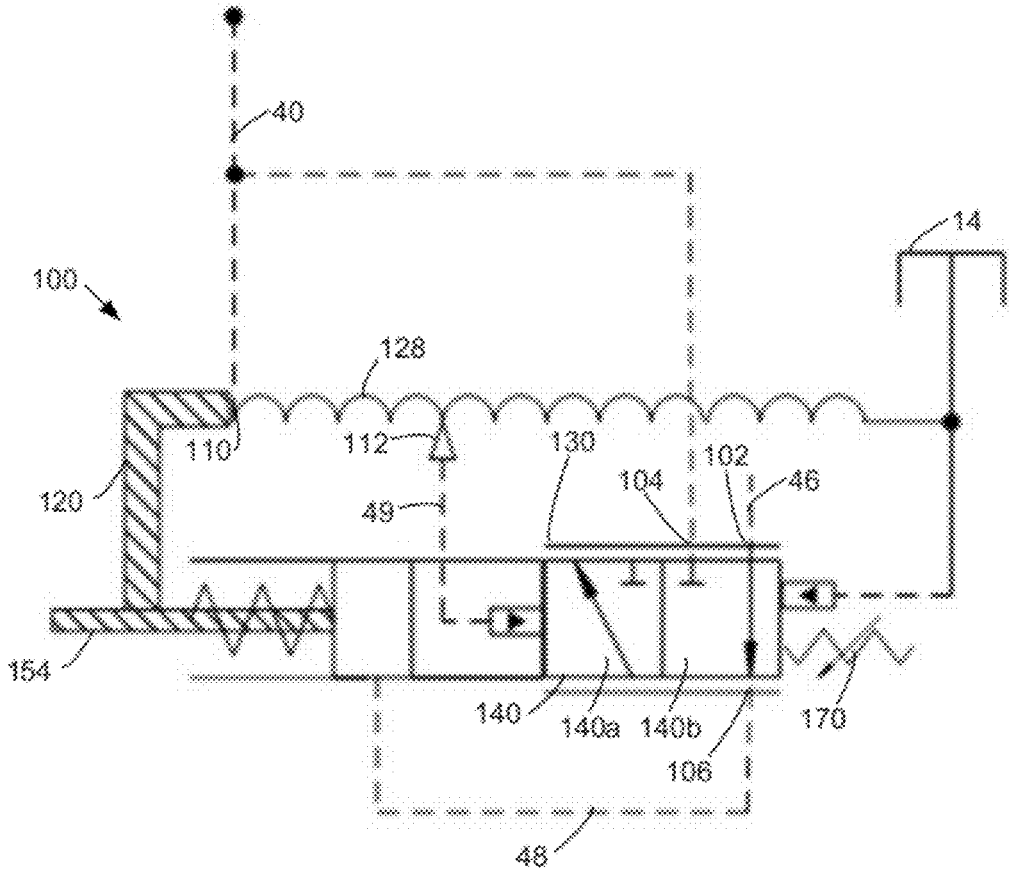
FIG. 2 is a hydraulic schematic of a first embodiment of a torque control valve for use in the pump control system of FIG. 1.

Referring to FIG. 2, torque control valve 100 is shown schematically in further detail. As shown, torque control valve has a sleeve 130 and a spool 140. The sleeve 130 has a compensator port 102 for receiving output 46, a system pressure port 104 for receiving system pressure 40, and a control pressure port 106 for activating a control piston 154 of the valve 100 at a control pressure 48. The control piston 154 is the element of the valve 100 that engages with the pump 10 to limit torque via contact with a swash plate 60.

Torque control valve 100 is further shown as having a piston rod 120 having a groove orifice feature 128. Groove orifice feature 128 receives system pressure 40 at an internal system pressure port 110 and provides a feedback pressure 49 at internal port 112 to act on the position of the spool 140 towards a first spool position 140*a*. A spring 170 is provided to bias the spool 140 in the opposite direction towards a second spool position 140*b*. In the first spool position 140*a*, the compensator port 102 is blocked and the control pressure port 106 is placed in fluid communication with the system pressure port 104. In the second spool position 140*b*, the system pressure port 104 is blocked and the control pressure port 106 is placed in fluid communication with the compensator port 102. As shown in FIG. 2, the spool 140 is placed in the second spool position 140*b*. Also, groove orifice feature 128 and spool 140 are in fluid communication with the tank 14.

Figure 3:
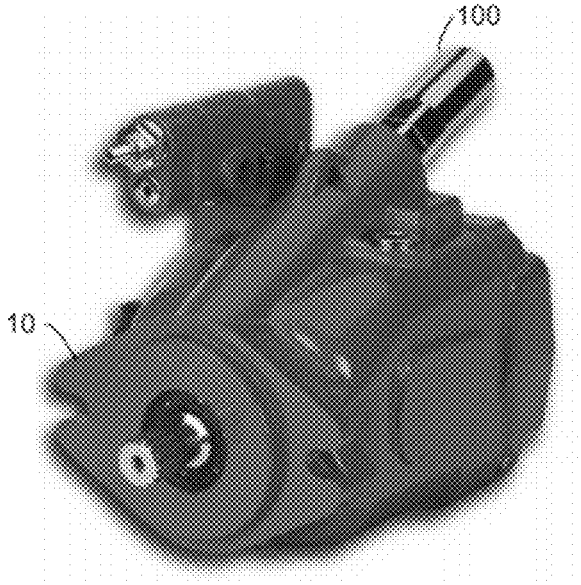
FIG. 3 is a perspective view of a pump having the torque control valve of FIG. 2 installed.
Figure 4:
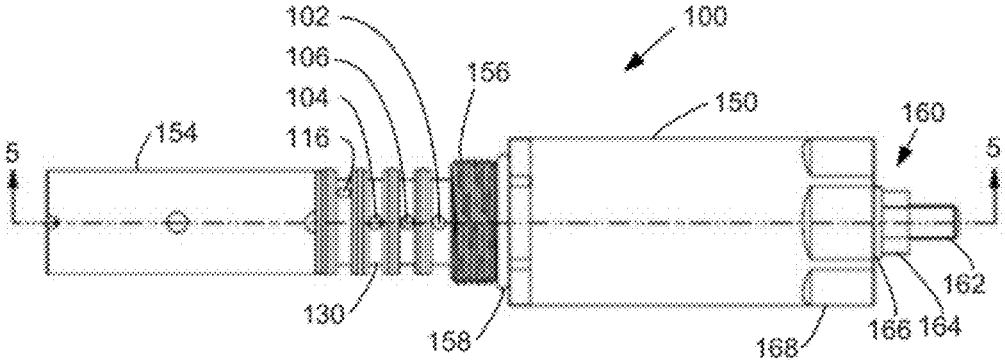
FIG. 4 is a side view of the torque control valve of FIG. 2.
Figure 7:
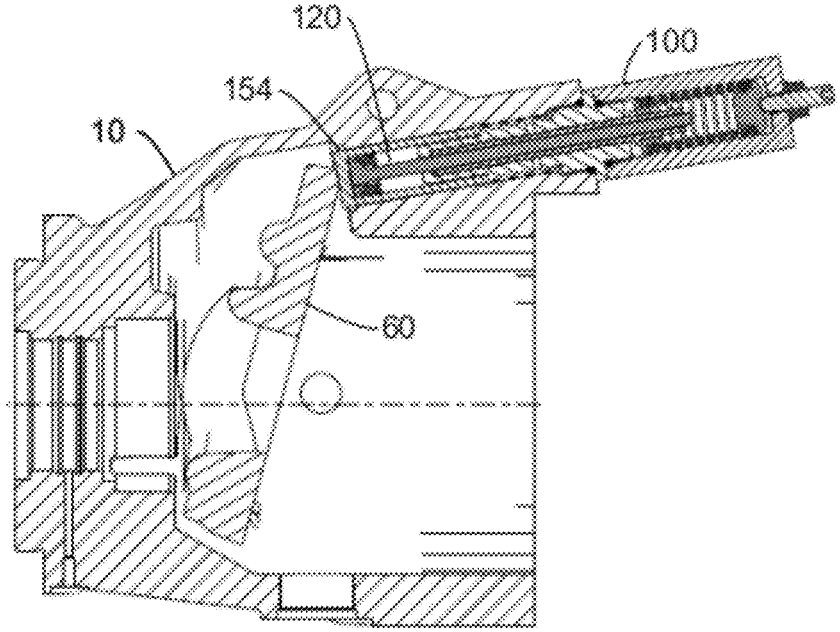
FIG. 7 is a cross-sectional view of a pump with the torque control valve in a fully stroked position schematically shown in FIG. 2 installed.
Figure 8:
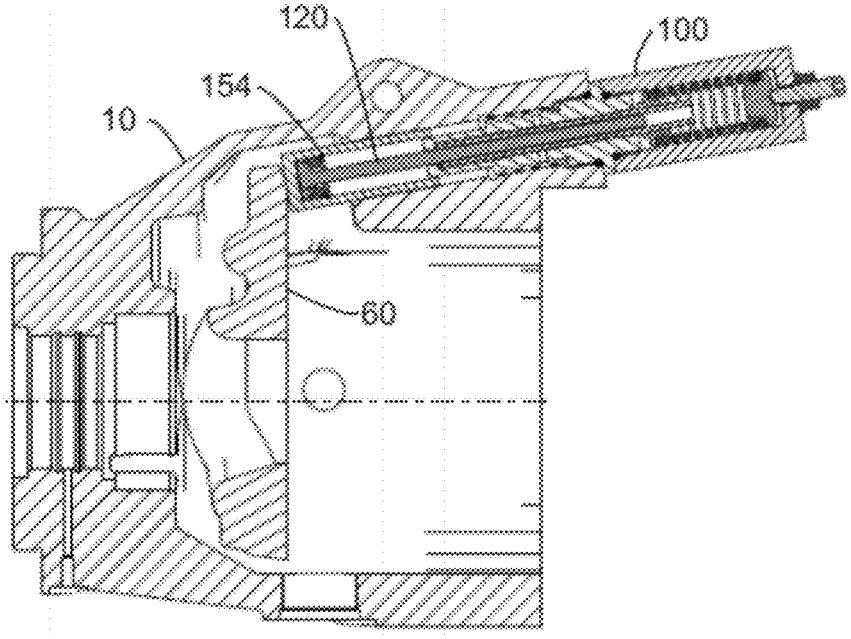
FIG. 8 is a cross-sectional view of the pump and torque control valve shown in FIG. 7 with the torque control valve being in a de-stroked position.

Referring to FIGS. 3 and 7-8, a physical representation of the pump 10 is provided with the torque control valve 100 installed. FIG. 4 shows a physical representation of the torque control valve 100 from a side view. In the embodiment shown, torque control valve 100 includes a casing 150 and a control piston 154. To provide for attachment to the pump, the torque control valve 100 may be provided with a threaded connection 156 and a gasket 158.

Torque control valve 100 is also shown as having a spring adjustment system 160. Spring adjustment system 160 is for allowing for the initial spring force exerted on the spool 140 by spring 170 to be pre-loaded to a desired value. As shown, spring adjustment system 160 includes a rod 162 that is threaded into an end plate 166. As rod 162 extends into the casing 150, the spring 170 is compressed, as most easily seen at FIG. 5. In order to lock the position of the rod 162, a lock nut 164 can be provided. Additionally, the casing 150 may be provided with an engagement feature 168 to allow for the lock nut 164 to be fully tightened or loosened. This external adjustability of the spring is an improvement over prior art torque control valves having internal adjustment mechanisms requiring removal and/or disassembly of the valve to make such an adjustment.

Figure 5:
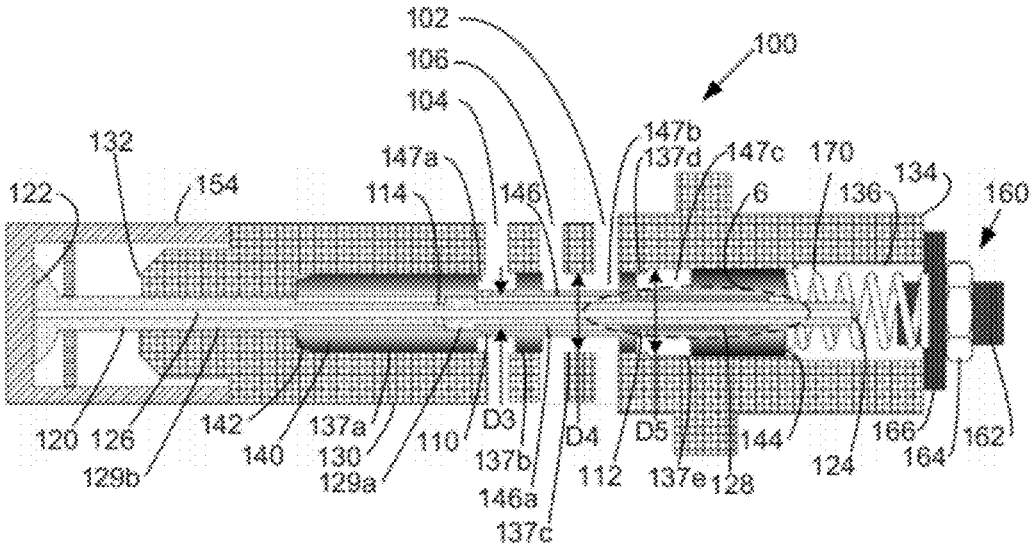
FIG. 5 is a cross-sectional view of the torque control valve of FIG. 2 taken along the line 5-5.

As can be seen at FIG. 5, the sleeve 130 of the torque control valve 100 is shown in further detail. The sleeve has a first axial end 132 and a second axial end 134 and a generally cylindrical central bore 136 extending there through. Similar to the arrangement shown in FIG. 4, sleeve 130 is shown as having a compensator port 102, a system pressure port 104, a control pressure port 106, and a tank or case port 116. The system pressure port 104 is defined between a first landing 137*a* and a second landing 137*b*. The control pressure port is defined between the second landing 137*b* and a third landing 137*c*. The compensator port 102 is defined between the third landing 137*c* and a fourth landing 137*d*. A fifth landing 137*e* is also provided. The first through fourth landings 137*a*-137*d* each have a diameter D4 while the fifth landing 137*e* has a diameter D5 that is greater than diameter D4.

Inserted within the central bore 136 of the sleeve 130 is the spool 140. Spool 140 slides within sleeve 130 in order to selectively place the valve 100 in the desired position. Spool 140 has a first axial end 142, a second axial end 144, and a generally cylindrical central bore 146 extending there through. The second axial end 144 of the spool 140 engages the spring 170. The spring 170 biases the spool 140 towards the first axial end 142. In the embodiment shown, central bore 146 has a diameter D3.

Spool 140 also has three recessed portions 147*a*-147*c* that provide for selective fluid communication between ports 102, 104, and 106 of the sleeve 130. At the first and second recessed portions 147*a*, 147*b*, the spool 140 has a diameter D4. At the third recessed portion 147*c*, the spool has a diameter D3 nearest the first axial end 142 and a diameter D5 nearest the second axial end 144. Accordingly, the spool 140 has a greater surface area at the second axial end 144 than at the first and second recesses 147*a*, 147*b*.

At the first recessed portion 147*a*, an internal port 110 is provided that allows for fluid communication from the sleeve ports 104 or 106 into the central bore 146 of the spool 140. A second internal port 112 is provided that allows for fluid communication from the central bore 146 of the spool 140 into the third recess 147*c*.

Extending through the central bore 146 of the spool 140 is a piston rod 120. Piston rod 120 is in a slidable relationship with spool 140 and activates the control piston 145. Piston rod has a first axial end 122, a second axial end 124, and a central bore 126 extending there through. At the first axial end 122, the piston rod 120 engages the control piston 154. At the second axial end 124, the piston rod 122 extends past the second axial end of the spool 140 where the central bore 126 is in fluid communication with case pressure fluid. An expanded portion 129 in communication with the central bore 126 and a port 114 in the rod 122 is also provided. The rod 122 has a general external diameter D2 and a larger external diameter D3 at expanded portions 129*a* and 129*b*. A port 114 is provided between the expanded portions 129*a*, 129*b* that allows for fluid communication between the central bore 126 of the piston rod 120 and the central bore 146 of the spool 140. Because diameter D2 is less than diameter D3, an interstitial annular space 146*a* is formed between the piston rod 122 and the central bore 146 of the spool 140 at certain locations.

Figure 6:
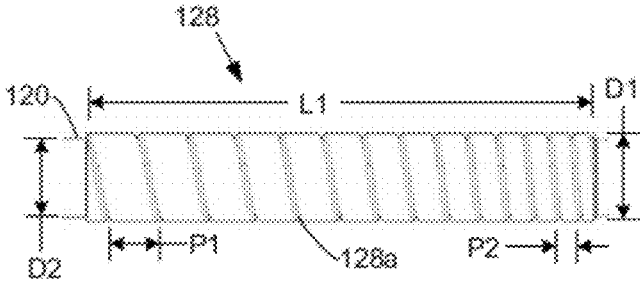
FIG. 6 is a side view of a groove feature on the control valve of FIG. 2.

Piston rod 120 also has a groove orifice feature 128, as shown in enlarged form on FIG. 6. Groove orifice feature 128 is for providing a resistive fluid flow path that results in a feedback pressure 49 being delivered to the third recess portion 147*c* of the spool 140. As configured, fluid at a system pressure 40, via port 110, is received into the interstitial annular space 146*a* and enters the groove orifice feature 128. The fluid travels along the groove orifice feature until the fluid reaches port 112 in the third recess 147*c* of the spool 140. At this point, the pressure of the fluid has dropped from the system pressure 40 to a feedback pressure 49.

In the embodiment shown, groove orifice feature 128 has a length L1 and an external diameter D1 that is approximately the same as diameter D3. Groove orifice feature 128 also has a spiral groove 128*a* that extends along the length L1 of the orifice feature 128. Because diameters D1 and D3 are approximately the same, fluid entering the groove orifice feature 128 must travel along the spiral groove 128*a*. As fluid travels along groove 128*a*, the pressure of the fluid is reduced down to the feedback pressure 49. Depending upon the position of the piston rod 120 relative to the spool 140, the feedback pressure 49 will be greater or less depending upon the ultimate distance the fluid must travel through the groove orifice feature 128 before exiting into the third recess portion 147*c* of the spool 140.

With reference to FIG. 6 specifically, it can be seen that the groove 128*a* has a variable pitch distance. By use of the term "variable pitch distance" it is meant that the pitch distance of the spiral groove changes along at least part of the length of the groove orifice feature. As shown, the pitch distance of the spiral groove 128*a* decreases gradually along the length L1 from an initial distance P1 to a final distance P2. The rate of this decrease can be geometric or exponential depending upon the desired pressure drop characteristics of the groove orifice feature 128. Additionally, the pitch distance can be constant for a portion of the orifice feature 128 and variable along another portion of the orifice feature 128. Due to the decreasing pitch distance, the fluid pressure drop per unit length along the groove orifice feature 128 correspondingly increases as fluid travels towards the third recess portion 147*c* of the spool 140.

As noted above, the third recess portion 147*c* has a larger spool diameter D5 (and surface area) closest to the second axial end 144 of the spool 140, as compared to the spool diameter D4 (and surface area) closest to the first axial end 142. Because of this configuration, the pressurized fluid at the feedback pressure 49 exiting the groove orifice feature 128 into the third recess portion 147*c* will exert a net force on the spool 140 in the direction of the second axial end 144. As noted previously, spring 170 exerts a force on the spool 140 in the opposite direction towards first axial end 142. Accordingly, the spring force and the feedback pressure 49 operate to control the position of the spool 140.

Figure 9:
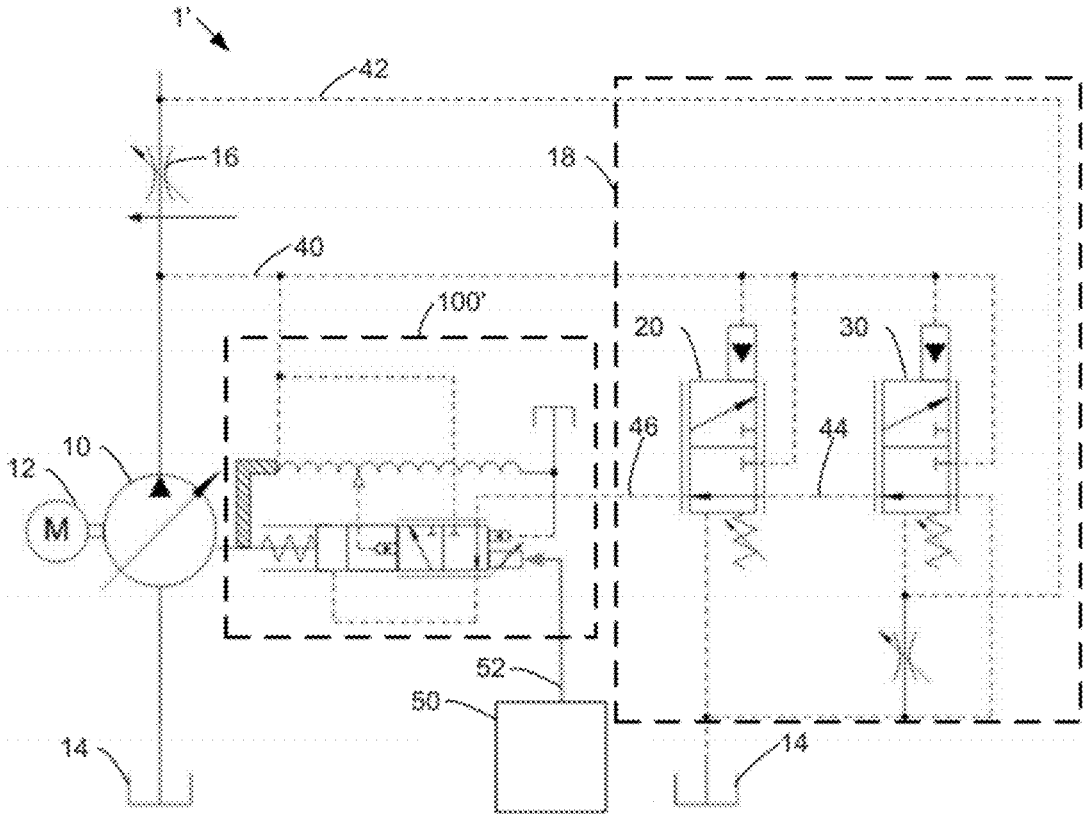
FIG. 9 is a hydraulic schematic of a second embodiment of a pump control system having features that are examples of aspects in accordance with the principles of the present disclosure.
Figure 10:
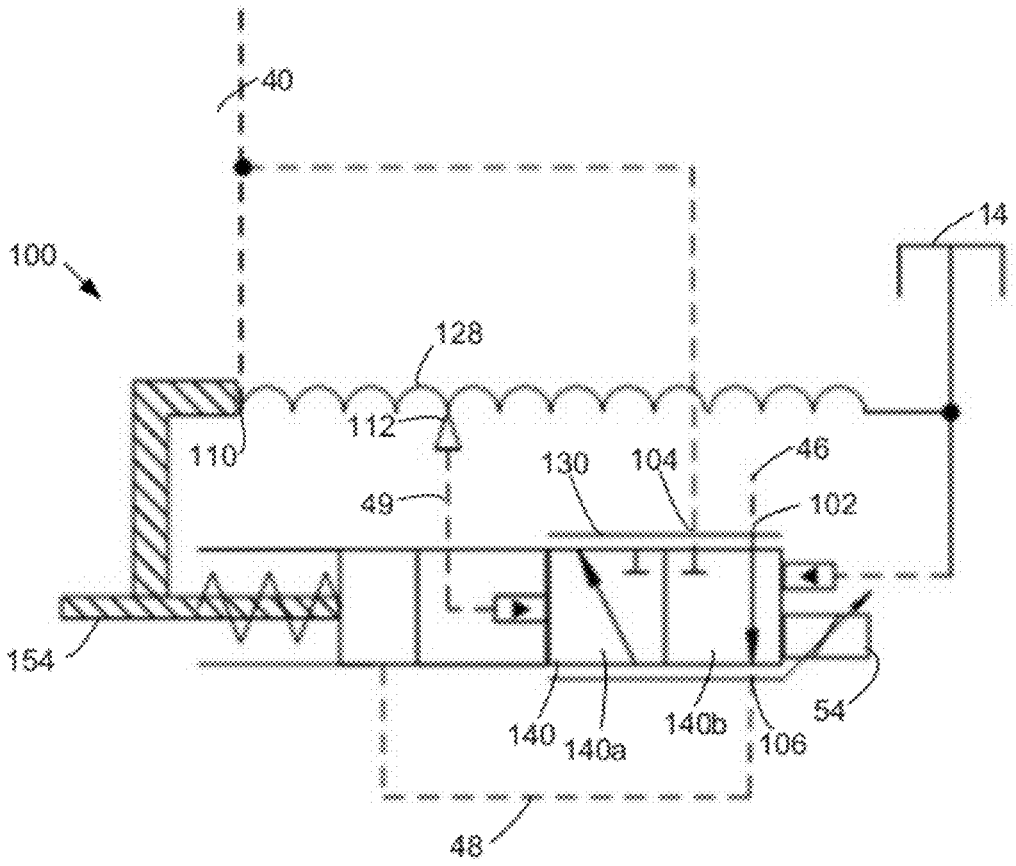
FIG. 10 is a hydraulic schematic of a second embodiment of a torque control valve for use in the pump control system of FIG. 9.
Figure 11:
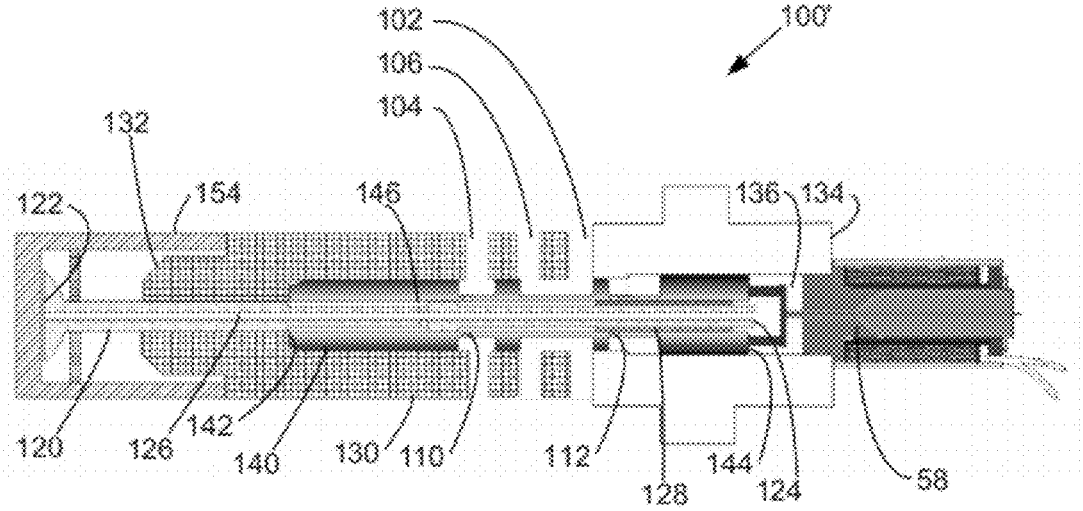
FIG. 11 is a cross-sectional view of the torque control valve schematically shown in FIG. 10.

With reference to FIGS. 9-11, a second embodiment of a pump control system l' and torque control valve 100' is presented. As many of the concepts and features are similar to the first embodiment shown in FIGS. 1-8, the description for the first embodiment is hereby incorporated by reference for the second embodiment. Where like or similar features or elements are shown, the same reference numbers will be used where possible. The following description for the second embodiment will be limited primarily to the differences between the first and second embodiments.

As shown at FIG. 9, pump control system l' additionally includes an electronic control unit 50 for electro-hydraulic operation of the torque control valve 100'. As can be seen at FIGS. 10-11, a solenoid actuator 54 is provided to bias spool 140 towards its first axial end 142 instead of relying upon spring 170. To actively apply a force to the torque control valve 100, a signal 52, such as a pulse width modulation (PWM) voltage, is supplied from the controller 50 to the solenoid actuator 58. In this manner, the solenoid actuator 54 can operate in place of the spring 170 to bias the spool 140 in a direction from the second axial end 144 towards the first axial end 142 of the spool 140.

Figure 12:
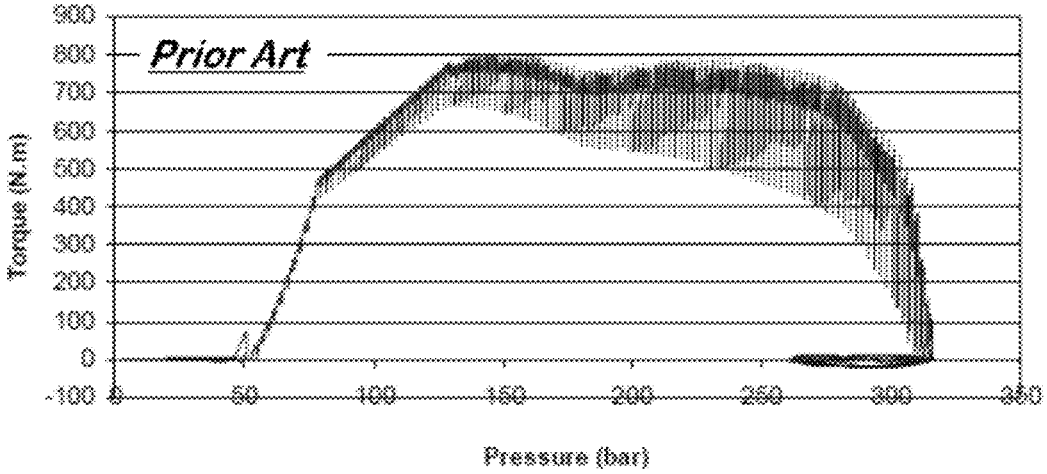
FIG. 12 is a modeled performance graph for a prior art hydro-mechanical torque control valve.
Figure 13:
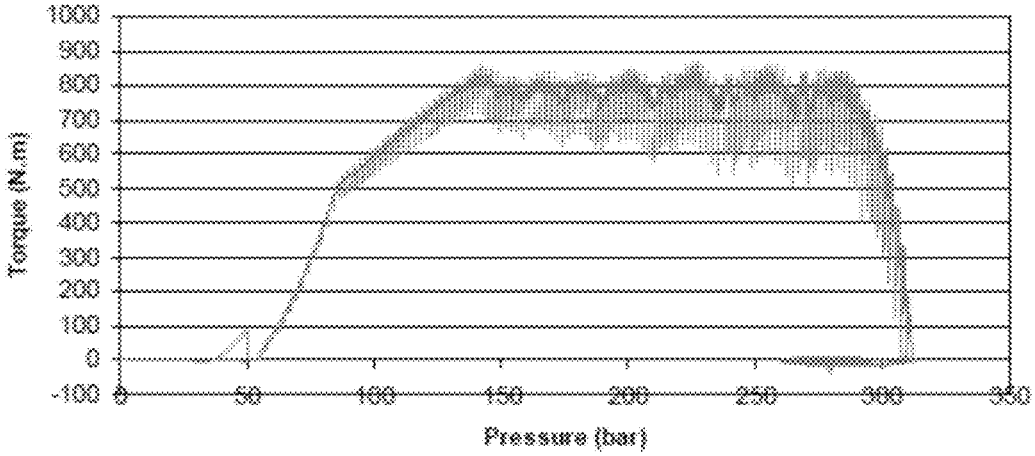
FIG. 13 is a modeled performance graph for a hydro-mechanical torque control valve embodying the concepts disclosed herein.

Referring to FIGS. 12 and 13, two modeled performance graphs are shown. FIG. 12 shows a modeled performance output of a prior art hydro-mechanical torque control valve. As can be seen the torque output of the valve gradually increases from about 50 to about 150 bar and then decreases to about 180 bar. The torque holds generally steady between about 180 bar and about 240 bar where torque increasingly declines to zero. In comparison, FIG. 13 shows a modeled performance output of a hydro-mechanical torque control valve utilizing the principles disclosed herein. As can be seen, torque holds generally constant from about 140 bar to about 290 bar. As such, the disclosed torque control valve is able to provide a more consistent torque output over a wider range of operating pressures.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

What is claimed is:

1. A torque control valve comprising:

(a) a sleeve having a first axial end, a second axial end, and a central bore, the sleeve having a system pressure port, a compensator pressure port, and a control pressure port, each pressure port extending into the sleeve central bore;

(b) a spool disposed within the central bore of the sleeve, the spool having a first axial end, a second axial end, and a central bore, the spool having a first recess area, a second recess area, and a third recess area between the first and second axial ends of the spool, the first and third recesses each having a port into the spool central bore; and (c) a piston rod disposed through the central bore of the spool, the piston rod including a groove orifice feature having a spiral groove with a first length, the piston rod being configured such that at least a portion of a fluid flowing from the port in the first recess area to the port in the third recess area must flow through at least a portion of the first length of the spiral groove, wherein the portion of the first length across which fluid flowing from the first recess area port to the third recess area port must traverse varies based on the position of the piston rod relative to the spool.

2. The torque control valve of claim 1, wherein the spiral groove orifice feature has a varying pitch distance.

3. The torque control valve of claim 2, wherein the pitch distance decreases as the spiral groove progresses in a direction towards the second axial end of the piston rod.

4. The torque control valve of claim 1, further comprising a spring engaged with the second axial end of the spool, the spring biasing the spool in a direction from the second axial end to the first axial end of the spool.

5. The torque control valve of claim 4, wherein a compression amount of the spring can be adjusted from an exterior of the torque control valve.

6. The torque control valve of claim 1, further comprising a solenoid valve engaged with the second axial end of the spool.

7. The torque control valve of claim 6, wherein the solenoid valve is configured to exert a force on the spool in a direction from the second axial end towards the first axial end of the spool.

8. The torque control valve of claim 1, wherein the fluid flowing into the port of the first recess area is at a system pressure and the fluid flowing into the port of the third recess area is at a feedback pressure, the feedback pressure being lower than the system pressure.

9. The torque control valve of claim 8, wherein the feedback pressure exerts a net force on the spool in a direction from the first axial end to the second axial end of the spool.

10. A pump system comprising:

(a) a variable displacement axial piston pump having a swashplate;

(b) a pressure limiting compensator valve;

(c) a load sense compensator valve; and (d) a torque control valve in fluid communication with the pressure limiting compensator valve and the load sense compensator valve, the torque control valve comprising:

i. a sleeve having a first axial end, a second axial end, and a central bore, the sleeve having a system pressure port, a compensator pressure port, and a control pressure port, each pressure port extending into the sleeve central bore;

ii. a spool disposed within the central bore of the sleeve, the spool having a first axial end, a second axial end, and a central bore, the spool having a first recess area, a second recess area, and a third recess area between the first and second axial ends of the spool, the first and third recesses each having a port into the spool central bore;

iii. a piston rod disposed through the central bore of the spool, the piston rod including a groove orifice feature having a spiral groove with a first length, the piston rod being configured such that at least a portion of a fluid flowing from the port in the first recess area to the port in the third recess area must flow through at least a portion of the first length of the spiral groove, wherein the portion of the first length across which fluid flowing from the first recess area port to the third recess area port must traverse varies based on the position of the piston rod relative to the spool; and iv. a control piston connected to the piston rod, the control piston engaging the swash plate of the pump.

11. The pump system of claim 10, wherein the spiral groove orifice feature has a varying pitch distance.

12. The pump system of claim 11, wherein the pitch distance decreases as the spiral groove progresses in a direction towards the second axial end of the piston rod.

13. The pump system of claim 10, further comprising a spring engaged with the second axial end of the spool, the spring biasing the spool in a direction from the second axial end to the first axial end of the spool.

14. The pump system of claim 13, wherein a compression amount of the spring can be adjusted from an exterior of the torque control valve.

15. The pump system of claim 10, further comprising a solenoid valve engaged with the second axial end of the spool.

16. The pump system of claim 15, wherein the solenoid valve is configured to exert a force on the spool in a direction from the second axial end towards the first axial end of the spool.

17. The pump system of claim 10, wherein the fluid flowing into the port of the first recess area is at a system pressure and the fluid flowing into the port of the third recess area is at a feedback pressure, the feedback pressure being lower than the system pressure.

18. The pump system of claim 17, wherein the feedback pressure exerts a net force on the spool in a direction from the first axial end to the second axial end of the spool.

* * * * *